US006158619A

United States Patent [19]

D'Andrade et al.

[11] Patent Number: 6,158,619

[45] Date of Patent: Dec. 12, 2000

[54] BLADDER GUN WITH BODY MOUNTED NOZZLE AND QUICK-CHARGED SYSTEM

[76] Inventors: Bruce M. D'Andrade, deceased, late of Whitehouse Station, N.J.; by Mary Ann D'Andrade, executix, 3 Ten Eyck Rd., Whitehouse Station, N.J. 08889

[21] Appl. No.: 09/225,798

[22] Filed: Jan. 5, 1999

Related U.S. Application Data

[60] Provisional application No. 60/088,957, Jun. 11, 1998.

[51] Int. Cl.[7] ..... A63H 33/00

[52] U.S. Cl. ..... 222/79; 222/212; 222/386.5; 446/473; 141/26

[58] Field of Search ..... 222/79, 183, 210, 222/212, 214, 386.5; 446/473; 141/81, 21, 25–28

[56] References Cited

U.S. PATENT DOCUMENTS

| | | | |
|---|---|---|---|
| 275,997 | 4/1883 | Chapelain | 222/79 |
| 600,552 | 3/1898 | Parker | 222/29 |
| 605,430 | 6/1898 | Humphrey | 222/79 |
| 617,495 | 1/1899 | Reimann | 222/29 |
| 688,882 | 12/1901 | Parker | 222/79 |
| 1,986,484 | 1/1935 | Schlueter . | |
| 2,237,678 | 4/1941 | Lohr et al. . | |
| 2,513,506 | 7/1950 | Mendelson . | |
| 2,802,298 | 8/1957 | Larin | 446/21 |
| 2,844,351 | 7/1958 | Smith . | |
| 3,151,706 | 10/1964 | Dillenburger et al. . | |
| 3,190,229 | 6/1965 | Turowski . | |
| 3,229,417 | 1/1966 | Stanzel . | |
| 3,232,001 | 2/1966 | Stanzel . | |
| 3,406,633 | 10/1968 | Schomburg . | |
| 3,486,539 | 12/1969 | Jacuzzi . | |
| 3,839,945 | 10/1974 | Jacobellis | 92/90 |
| 3,848,808 | 11/1974 | Fetty et al. | 239/327 |
| 3,876,115 | 4/1975 | Venus, Jr. et al. | 222/183 |
| 3,878,639 | 4/1975 | Scheelar et al. . | |
| 4,121,737 | 10/1978 | Kain | 222/95 |
| 4,135,559 | 1/1979 | Barnby | 141/18 |
| 4,194,461 | 3/1980 | Kubiatowicz . | |
| 4,212,560 | 7/1980 | Kraft . | |
| 4,257,460 | 3/1981 | Paranay et al. | 141/26 |
| 4,319,426 | 3/1982 | Lee . | |
| 4,458,830 | 7/1984 | Werding | 222/131 |
| 4,673,010 | 6/1987 | Prufer et al. | 141/382 |
| 4,735,239 | 4/1988 | Salmon et al. | 141/25 |
| 4,807,586 | 2/1989 | Kao . | |
| 4,854,480 | 8/1989 | Shindo | 222/79 |
| 4,867,208 | 9/1989 | Fitzgerald et al. | 141/18 |
| 4,890,838 | 1/1990 | Rudell et al. . | |
| 4,892,081 | 1/1990 | Moormann . | |
| 4,944,521 | 7/1990 | Greeno . | |
| 4,991,847 | 2/1991 | Rudell et al. . | |
| 5,018,449 | 5/1991 | Eidson, II . | |
| 5,032,100 | 7/1991 | Goldfarb . | |
| 5,064,095 | 11/1991 | Camerino . | |
| 5,088,522 | 2/1992 | Rath et al. . | |
| 5,127,118 | 7/1992 | Johenning . | |
| 5,174,477 | 12/1992 | Schafer . | |
| 5,184,755 | 2/1993 | Brovelli | 222/79 |

(List continued on next page.)

OTHER PUBLICATIONS

Yes! Entertainment Speed Loader 1500 instructions. ©1997. Not admitted as prior art.

*Primary Examiner*—J. Casimer Jacyna
*Attorney, Agent, or Firm*—Akin, Gump, Strauss, Hauer & Feld, L.L.P.

[57] ABSTRACT

The present invention relates to a gun device for dispensing a fluid with a quick charge adapter. The gun device includes a bladder located within a housing. The bladder is connected to a remotely located control unit which is adapted to dispense fluid stored in the bladder upon activation of a trigger located on the control unit. The fluid is dispensed from a remotely located nozzle which may be worn on a user's head. A recharge nozzle located on the control unit is adapted to be inserted into the quick charge adapter to quickly expand and fill the bladder from a pressurized fluid source.

17 Claims, 6 Drawing Sheets

U.S. PATENT DOCUMENTS 5,234,129 8/1993 Lau .
5,240,450 8/1993 Graham .
5,288,256 2/1994 Lee et al. .
5,336,051 8/1994 Tamari .
5,354,225 10/1994 Hix .
5,366,108 11/1994 Darling ..... 222/1
5,373,833 12/1994 D'Andrade ..... 124/69
5,373,975 12/1994 Husted ..... 222/394
5,529,525 6/1996 Deal .
5,531,626 7/1996 Deal ..... 446/473
5,531,627 7/1996 Deal ..... 446/473
5,586,688 12/1996 Johnson et al. ..... 222/79
5,603,361 2/1997 Cuisinier ..... 141/26
5,799,827 9/1998 D'Andrade ..... 222/79
5,850,941 12/1998 Johnson et al. .
5,875,927 3/1999 D'Andrade ..... 222/79
5,915,771 6/1999 Amron ..... 222/79

BLADDER GUN WITH BODY MOUNTED NOZZLE AND QUICK-CHARGED SYSTEM

CROSS REFERENCE TO RELATED APPLICATIONS

This application claims the benefit of U.S. Provisional application Ser. No. 60/088,957, filed Jun. 11, 1998.

BACKGROUND OF THE INVENTION

The present invention is directed to a gun type device for dispensing fluid having an expandable bladder member for storing fluid under pressure, and more particularly, to a gun type device in which a pressurized fluid chamber, a trigger control device and a shooting nozzle are provided as separate units which can be individually held or attached to a user's body.

Bladder guns having on-board pumps are known, such as disclosed in Applicant's prior U.S. patent application Ser. No. 08/672,941, filed on Jun. 28, 1996, now U.S. Pat. No. 5,799,827, issued Sep. 1, 1998, which is incorporated herein by reference as if fully set forth. Such guns have generally been filled with water for use as toys and have proven to be extremely popular and successful in the market. However, a user is required to manually actuate the pump which takes additional time and may be difficult for younger users.

It would be desirable to provide a gun which can be rapidly charged using an external pressurized fluid source, such as public water, which is readily available. It would be desirable to allow rapid charging of the gun without the need for using a manual pump. Additionally, it would be desirable to provide a gun which is provided in discrete components which can be separately secured to or carried by the user.

BRIEF SUMMARY OF THE INVENTION

Briefly stated, the present invention provides a gun device for ejecting fluid. The gun device includes a bladder assembly having an expandable bladder located therein. A control unit is provided in fluid communication with the bladder assembly. The control unit is located remotely from the bladder assembly. A nozzle assembly is provided in fluid communication with the control unit. The nozzle assembly is also located remotely from the control unit and the bladder assembly. Activation of the control unit allows fluid to flow from the bladder assembly, through the control unit, and to the nozzle assembly for discharge.

In another aspect, the present invention provides a combination of a gun device and a quick charge adapter for charging the gun device with pressurized fluid. The gun device includes a bladder assembly having an expandable bladder located therein. A control unit is located in fluid communication with the bladder assembly. The control unit is located remotely from the bladder assembly. A recharge nozzle is located in fluid communication with the control unit. A nozzle assembly is also located in fluid communication with the control unit. The nozzle assembly is located remotely from the control unit and the bladder assembly. Activation of the control unit allows fluid to flow from the bladder assembly, through the control unit, and the nozzle assembly for discharge. A quick charge adapter is provided which is adapted to be in fluid communication with a pressurized fluid source. The quick charge adapter includes a receptacle adapted to receive the control unit recharge nozzle. The recharge nozzle is adapted to be inserted into the quick charge adapter such that pressurized fluid flows from the quick charge adapter, through the recharge nozzle and the control unit to the bladder assembly.

In another aspect, the present invention provides a combination of a gun device and a quick charge adapter. The gun device includes a bladder assembly. The bladder assembly includes a bladder housing which has an open end and an expandable bladder is located within the bladder housing. The expandable bladder has an open first end and a closed second end. The bladder assembly includes mounting provisions such that the bladder housing is adapted to be worn by a user. A control unit is provided in fluid communication with the expandable bladder. The control unit is located separately from the expandable bladder. The control unit includes a control unit manifold located in a control unit housing. The control unit manifold is in fluid communication with the bladder assembly whereby fluid can flow between the expandable bladder and the control unit manifold. A trigger and a release valve are connected to the control unit. The release valve is in fluid communication with the control unit manifold. A pressure relief valve is also located in fluid communication with the control unit manifold. A recharge nozzle is located in fluid communication with the control unit. A nozzle assembly is located remotely from and in fluid communication with the control unit manifold. Activation of the trigger allows fluid to flow from the expandable bladder, through the control unit, to the nozzle assembly for ejection. A quick charge adapter which is adapted to be in fluid communication with a pressurized fluid source is provided. The recharge nozzle is adapted to be inserted into the quick charge adapter to place the pressurized fluid source into fluid communication with the control unit such that pressurized fluid flows from the quick charge adapter, through the recharge nozzle and the control unit to the expandable bladder.

The bladder is expanded by the pressurized fluid.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1A:
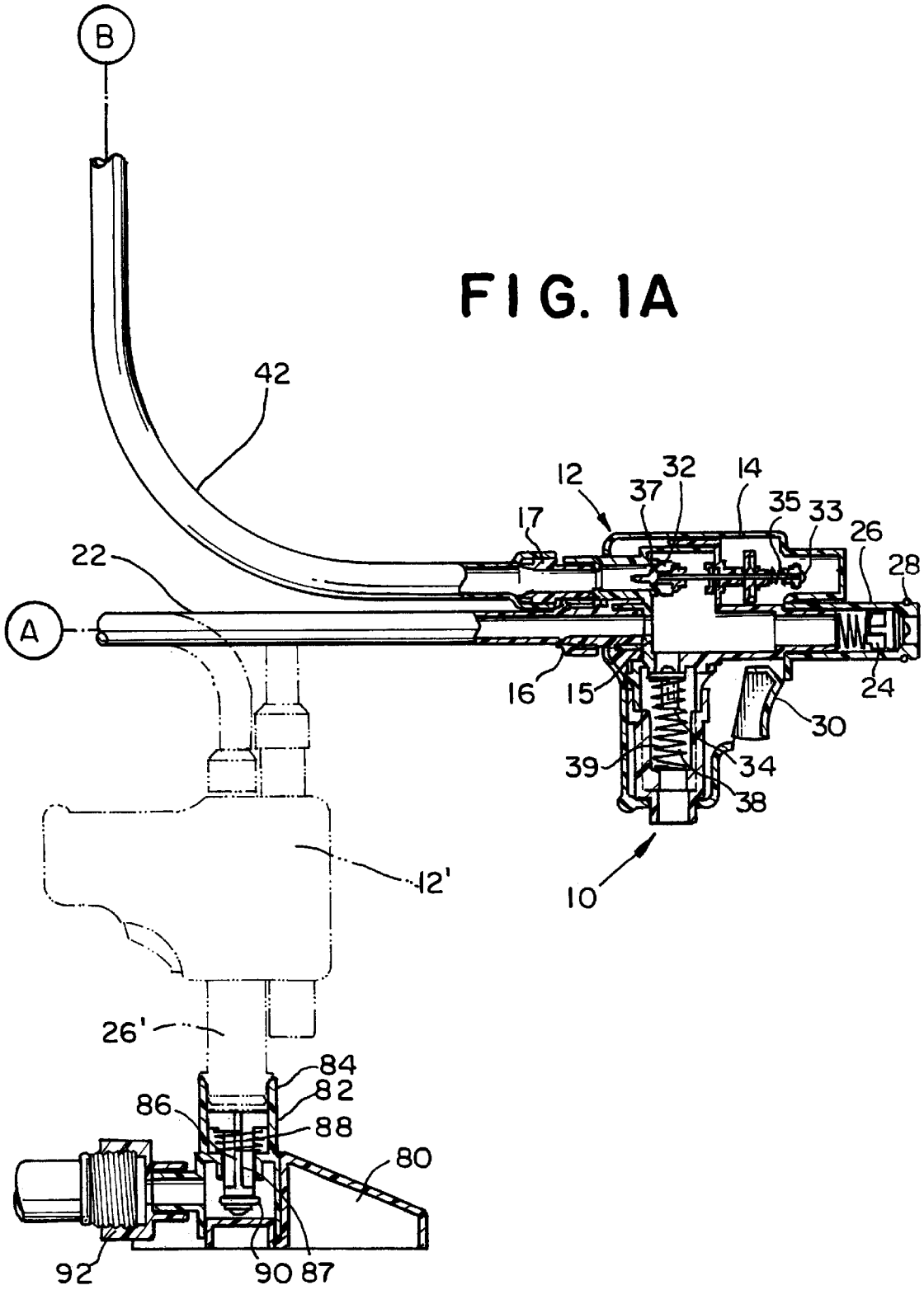
FIG. 1A is a side elevational view, partially in cross section, of the control unit used in the gun device of the present invention.

Certain terminology is used in the following description for convenience only and is not limiting. The words "right,"

"left," "lower" and "upper" designate directions in the drawings to which reference is made. The words "inwardly" and "outwardly" refer to directions towards and away from, respectively, the geometric center of the gun device in accordance with the present invention, and designated parts thereof. The terminology includes the words noted above as well as derivatives thereof and words of similar import.

Referring to the drawings, wherein like numerals indicate like elements throughout, there is shown in FIGS. 1A–1C and 2–6 a gun device 10 for ejecting fluid in accordance with the present invention. The gun device 10 includes a control unit 12 (shown in FIG. 1A) which is in fluid communication with a bladder assembly 50 (shown in FIG. 1B) via a first hose 22, and a body attachable nozzle assembly 40 (shown in FIG. 1C) via a second hose 42. The control unit 12, the bladder assembly 50 and the nozzle assembly 40 are all located remotely from each other. Activation of the control unit 12 allows fluid stored in the bladder assembly 50 to flow via the first hose 22 through the control unit 12 and via the second hose 42 to the nozzle assembly 40 for discharge. A quick charge adapter 80 is provided which is adapted to be used to charge the gun device 10 with pressurized fluid from an external source, such as public water. While the preferred embodiment of the gun device 10 is intended to be used with water as a recreational toy, it will be recognized by those skilled in the art from the present disclosure that the gun device 10 can be used with other fluids for other purposes, if desired. For the purposes of the present description, the gun device 10 will be referred to in connection with its use as a water gun, although this is not intended to be limiting.

Figure 1B:
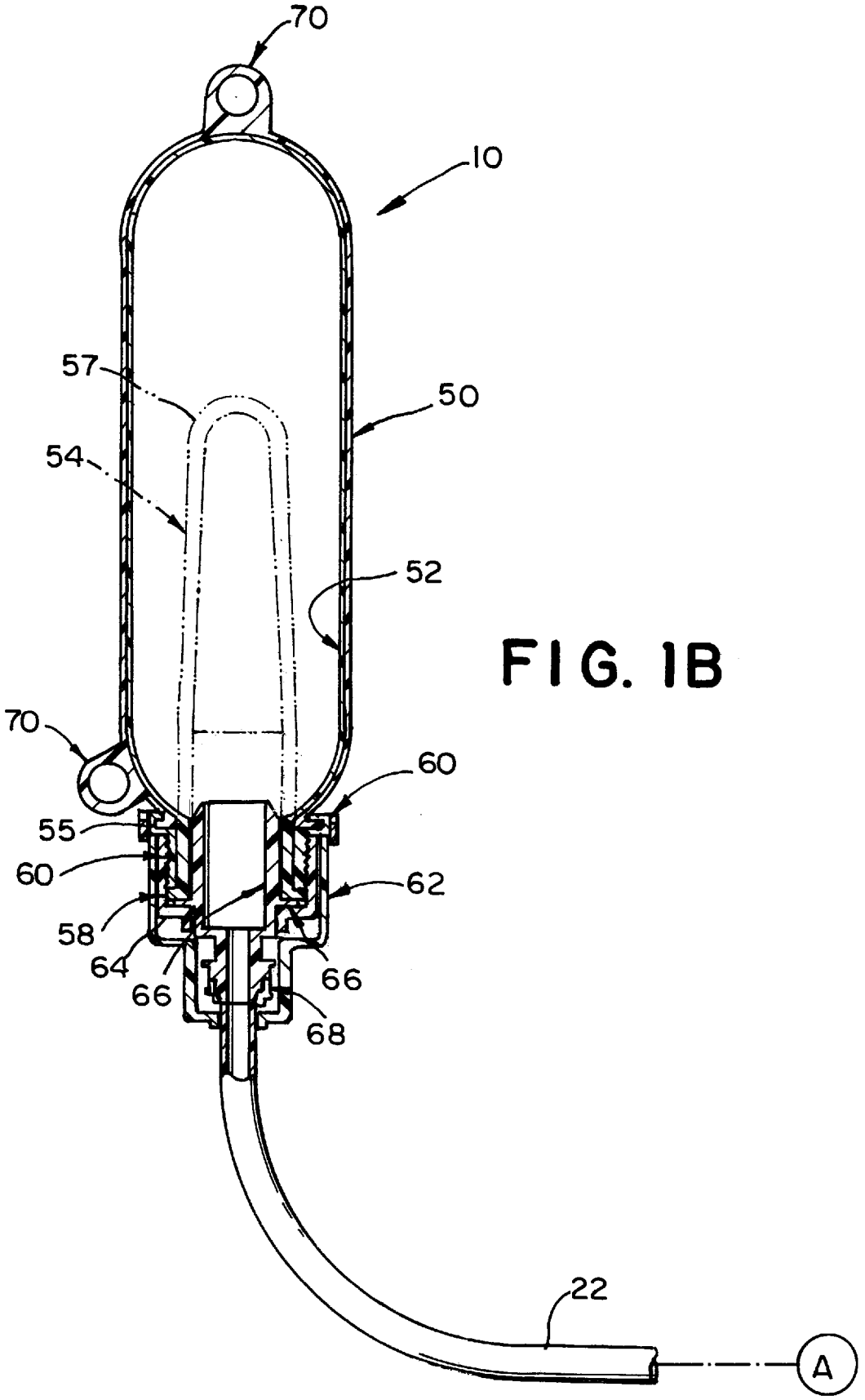
FIG. 1B is an elevational view, partially in cross section, of a bladder assembly for holding pressurized fluid which is connected to the control unit shown in FIG. 1A at A.
Figure 2:
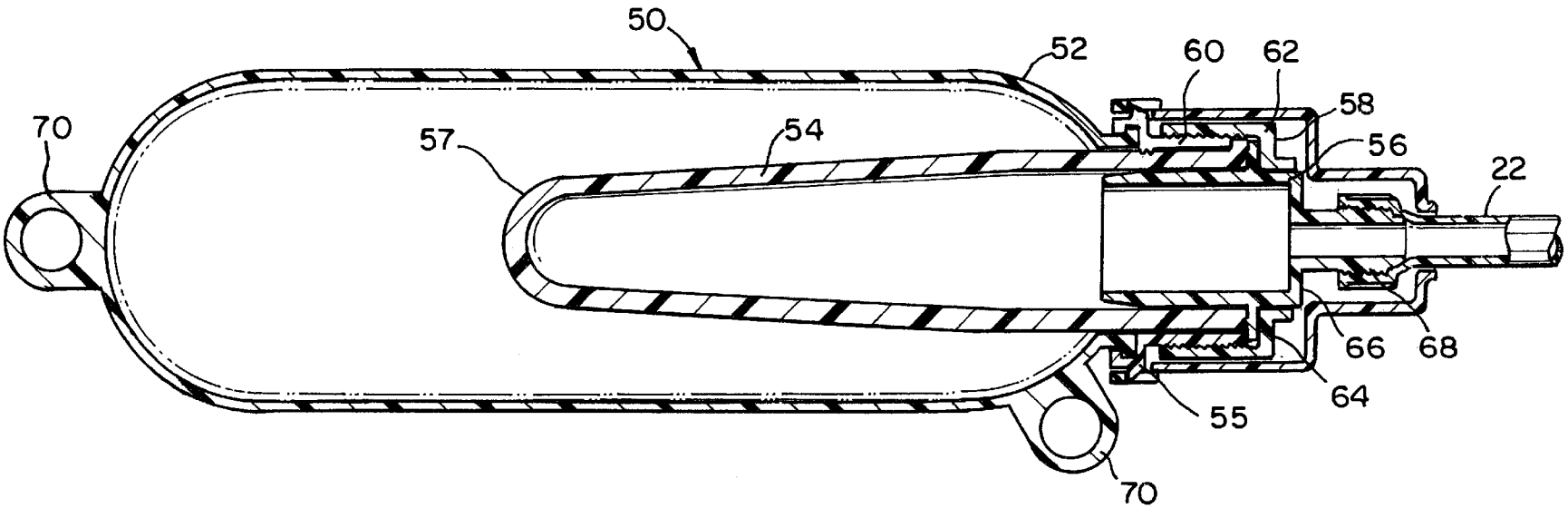
FIG. 2 is an enlarged cross-sectional view of the bladder assembly for holding pressurized fluid shown in FIG. 1B.

Referring now to FIG. 1B and 2, the bladder assembly 50 is shown. The bladder assembly 50 includes a bladder housing 52 which is preferably a blow-molded container. The bladder housing 52 has an open end 55. An expandable bladder 54 having an open first end 56 and a closed second end 57 is located in the bladder housing 52, with the open end 56 of the expandable bladder 54 being positioned at the open end 55 of the bladder housing 52. The expandable bladder 54 is located in the bladder housing 52 such that, upon charging the expandable bladder 54 with fluid, the expandable bladder 54 expands and is supported by the bladder housing 52. Preferably, the expandable bladder 54 is made of a natural rubber material and has a conically tapered shape, with the open end 56 larger than the closed end 57. This allows the bladder 54 to be made in a two piece mold (not shown) that allows the male mandrel to be easily withdrawn from the bladder 54, and the bladder 54 can be easily removed from the female portion of the mold. It will be recognized by those skilled in the art from the present disclosure that other types of bladders may be used for holding and storing fluid under pressure and that these other types of bladder designs may be utilized. One such bladder is disclosed in Applicant's U.S. application Ser. No. 08/672,942, filed Jun. 28, 1996, now U.S. Pat. No. 5,758,800, issued Jun. 2, 1998, which is incorporated herein as if more fully set forth.

A flange 58 is located around the open end 56 of the expandable bladder 54. The flange 58 is used to secure the expandable bladder 54 within the bladder housing 52. A threaded neck portion 60 is attached to the bladder housing 52 at the open end 56. A collar 62 having threads complementary to the neck portion 60 and having a radially inwardly extending flange 64 is threaded onto the neck portion 60, clamping an insert 66 and the flange 58 of the bladder 54 against the neck portion 60. Preferably, the insert 66 has a connection 68 which allows for the attachment of the first hose 22 to the insert 66. Preferably, mounting provisions, such as hangers 70, are provided on the bladder housing 52 for attachment of a strap or VELCRO® such that the bladder assembly 50 is adaptable to be worn by a user for ease of transport during use. The location and form of the hangers 70 can be varied, as desired.

As shown in FIGS. 1A and 3–6, the control unit 12 includes a control unit housing 14 in which a control unit manifold 15 is located. The first hose 22 is connected to the control unit manifold 15 via a first connection 16, providing fluid communication between the expandable bladder 54 in the bladder assembly 50 and the control unit manifold 15. The second hose 42 is connected to the control unit manifold 15 via a second connection 17, providing a path of fluid communication between the nozzle assembly 40 and the control unit manifold 15. A cylindrical recharge nozzle 26 is provided on the front of the control unit housing 14, and a check valve 24 is located in the recharge nozzle 26. An O-ring 28 is located on the outside of the recharge nozzle 26. The recharge nozzle 26 is in fluid communication with the control unit manifold 15. The recharge nozzle 26 is adapted to receive pressurized fluid from an external source of pressurized fluid to charge the expandable bladder 54 with fluid under pressure.

Figure 3:
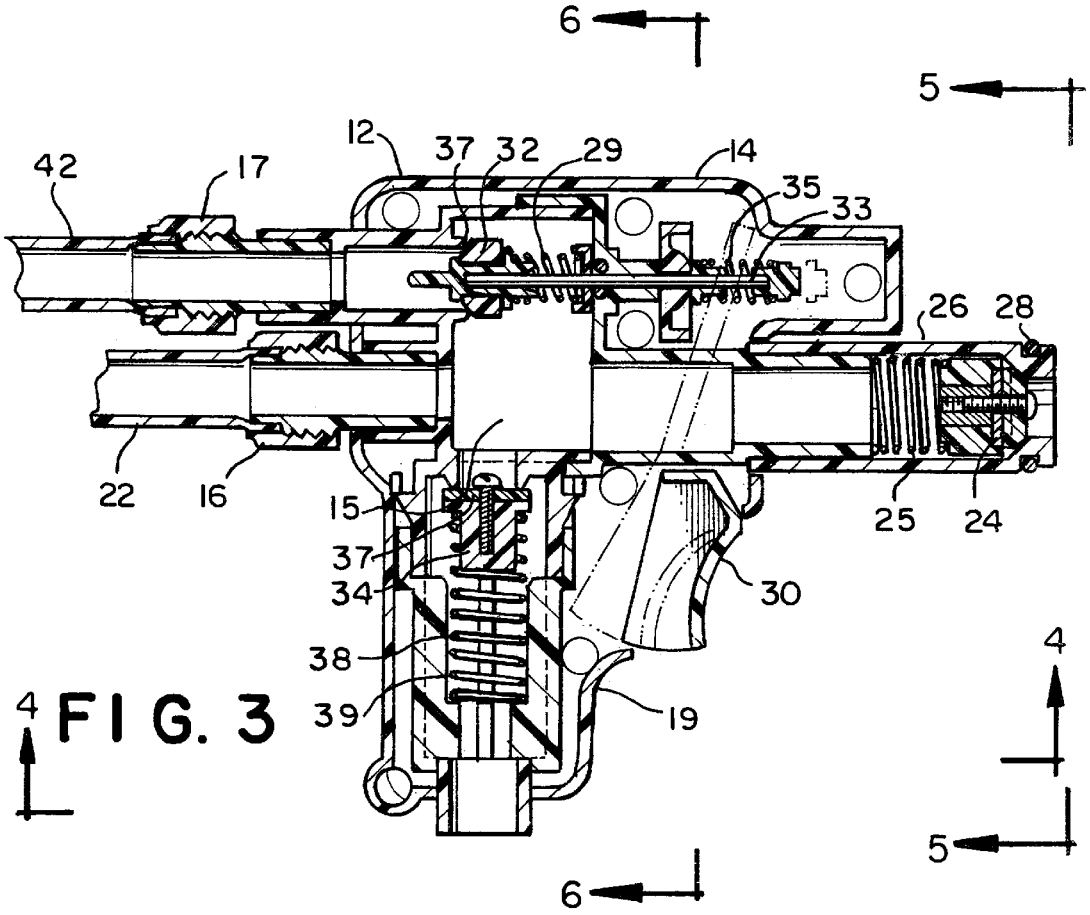
FIG. 3 is an enlarged cross-sectional view of the control unit shown in FIG. 1A.

As shown in detail in FIG. 3, a trigger 30 is pivotally mounted to the control unit housing 14 for movement via pins 31 (shown in FIG. 6) and is connected to a release valve 32. The release valve 32 is in fluid communication with the control unit manifold 15. Preferably, the trigger 30 is connected to a stem 33 which extends from the release valve 32, and activation of the trigger 30 opens the release valve 32 to pass fluid from the control unit manifold 15 to the nozzle assembly 40 for discharge. The release valve 32 is biased to a closed position, preferably against an opening 37 in the control unit manifold 15 by release valve spring 29. When the trigger 30 is actuated, the pivoting action of the trigger 30 compresses a delay spring 35 until sufficient energy is stored to overcome the spring force of the valve spring 29, and the stem 33 snaps the release valve 32 from its normally closed position against the opening 37 in the control unit manifold 15 to allow fluid to be discharged from the control unit 12 through the second hose 42 to the nozzle assembly 40. When the trigger 30 is released, the release valve 32 returns to a closed position, shutting off the flow of fluid to the nozzle assembly 40 through the second hose 42. Preferably, the release valve 32 is similar to that disclosed in Applicant's prior U.S. Pat. No. 5,339,987, which is incorporated herein by reference as if fully set forth. However, it will be recognized by those skilled in the art from the present disclosure that other valves may be used, if desired.

Figure 4:
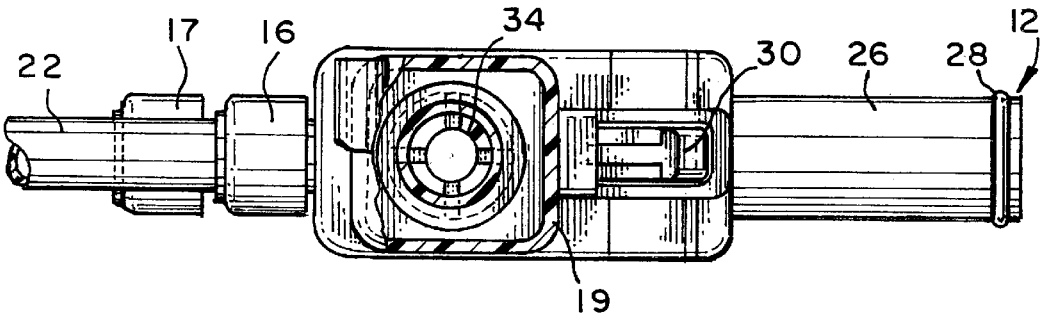
FIG. 4 is a bottom plan view taken along lines 4—4 in FIG. 3.
Figure 5:
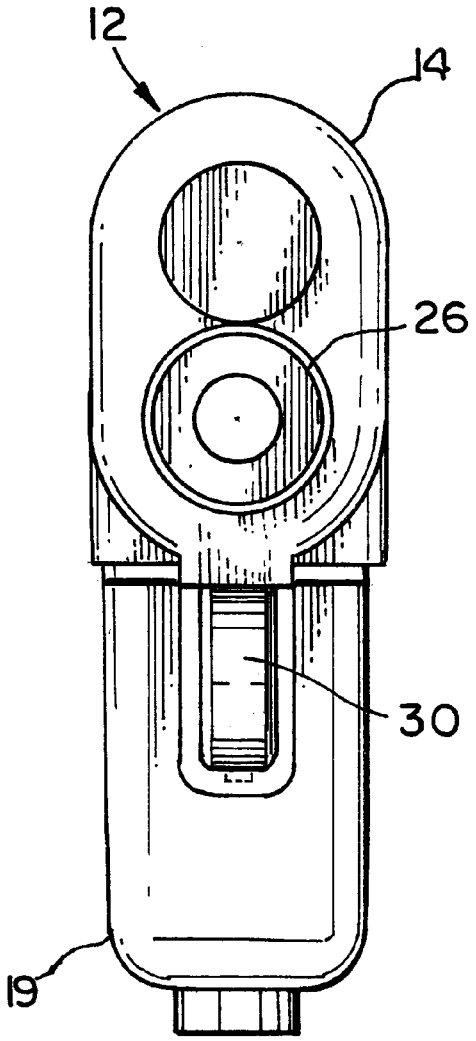
FIG. 5 is a right side elevational view taken along lines 5—5 in FIG. 3.
Figure 6:
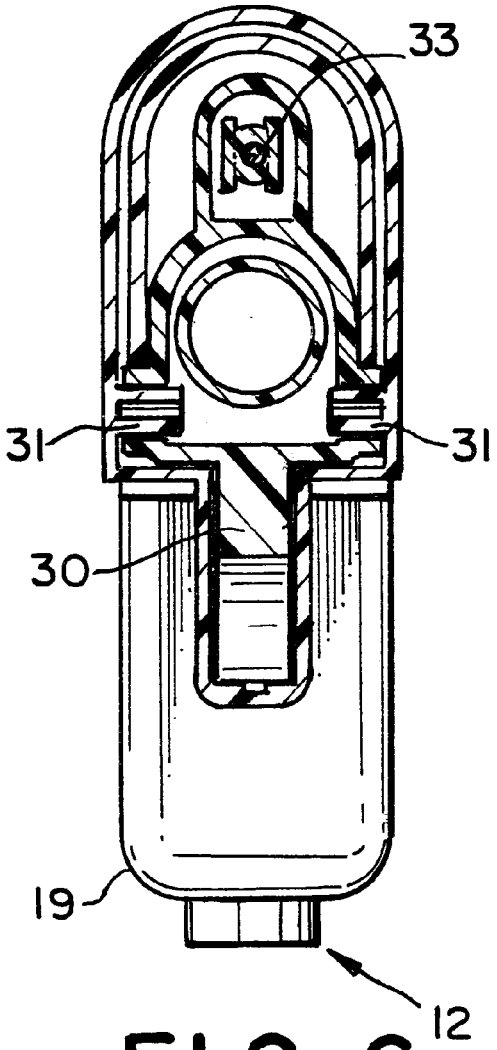
FIG. 6 is a cross-sectional view taken along lines 6—6 in FIG. 3.

As shown in FIGS. 3 and 4, a pressure relief valve 34 is located on the control unit 12 and is in fluid communication with the control unit manifold 15 to prevent overpressurization of the gun device 10. The pressure relief valve 34 discharges fluid outside the housing 14 through the handle 19. Preferably, the pressure relief valve 34 includes a spring loaded valve body 39 having a calibrated spring 38 such that the amount of pressure required in order for the relief valve 34 to open is set at a predetermined pressure, such as 32 psi. However, it will be recognized by those skilled in the art from the present disclosure that other types of pressure relief valves and other pressure settings may be utilized, if desired. It will also be recognized by those skilled in the art that the pressure relief valve 34 can be located on the control unit 12, the quick charge adapter 80 or at any other point in fluid communication with the bladder 54 during recharging.

Referring to FIGS. 1A and 3, the O-ring seal 28 located in a groove on the outside of the recharge nozzle 26 provides a generally fluid tight connection to the quick charge adapter 80 when the recharge nozzle 26 is inserted into the quick charge adapter 80. A recharge nozzle spring 25 biases the check valve 24 to a closed position against the inside of the recharge nozzle 26 to prevent pressurized fluid from escaping from the recharge nozzle 26. The recharge nozzle 26 is adapted to receive pressurized fluid from an external source of pressurized fluid to charge the expandable bladder 54 with fluid under pressure.

As shown in FIG. 3, the release valve 32 and the check valve 24 are located within the same chamber and are in fluid communication with the control unit manifold 15 such that the same fluid path is used for both charging the bladder assembly 50 and also discharging fluid from the bladder assembly 50 through the control unit manifold 15 to the nozzle assembly 40.

Figure 1C:
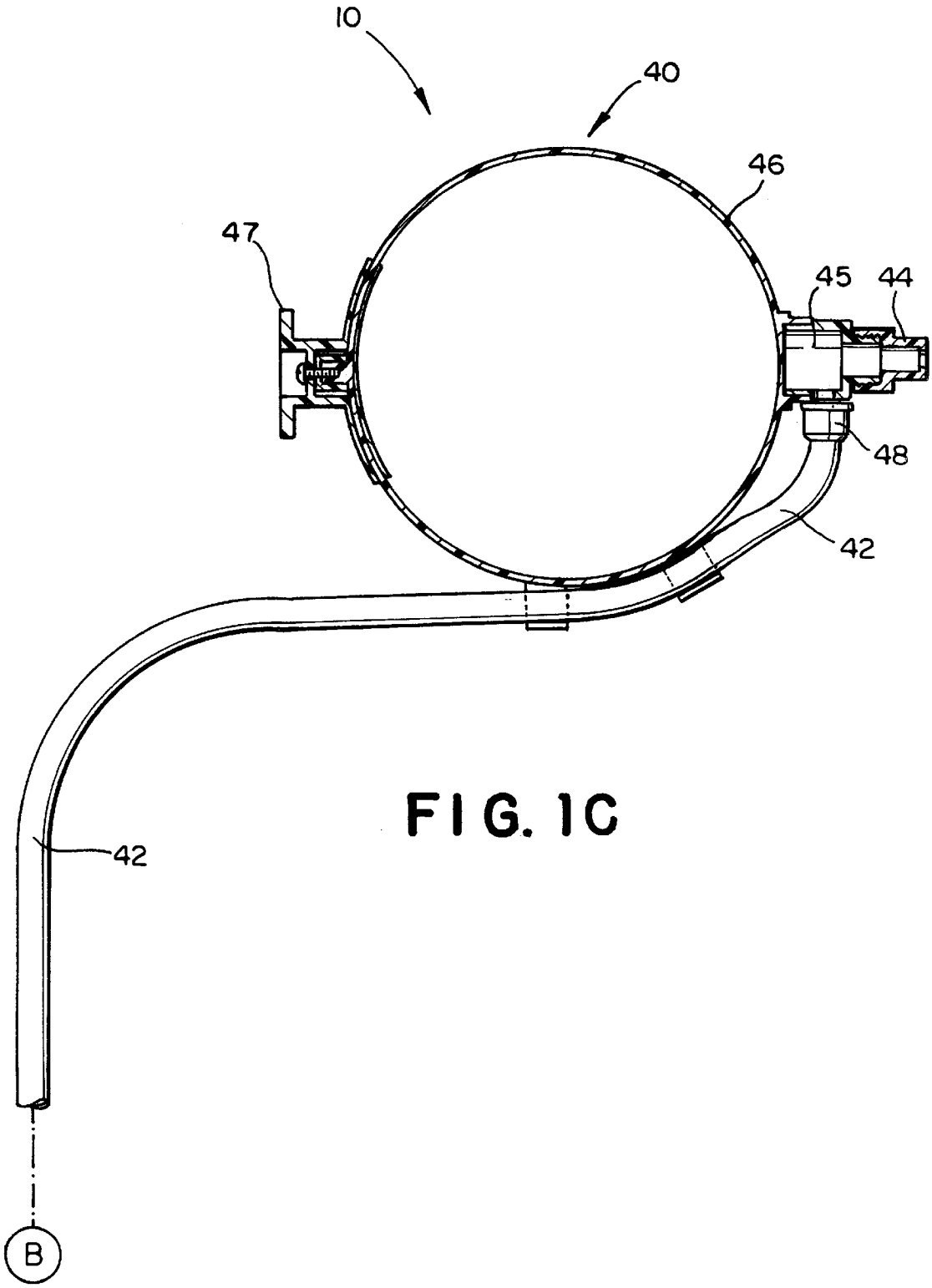
FIG. 1C is a plan view of a nozzle assembly which is connected to the control unit in FIG. 1A at B.

Referring to FIG. 1C, the nozzle assembly 40 is shown. Preferably, the nozzle assembly 40 includes a nozzle 44 having a nozzle body 45 which is connected to an adjustable headband 46 such that the nozzle assembly 40 is adapted to be worn on the user's head. Preferably, the headband 46 includes an adjustment knob 47 having a rack and pinion arrangement which pulls the two sides of the headband 46 either closer together or further apart in a manner which is known to those skilled in the art. Other types of adjustment mechanisms, such as VELCRO® straps, can also be used. A connection 48 is located on the nozzle body 45 for attachment of the second hose 42 such that the second hose 42 is in fluid communication with the nozzle 44. It will be recognized by those skilled in the art from the present disclosure that the nozzle 44 may be mounted on the front or side of the headband 46, if desired. It will be similarly recognized that the nozzle 44 may also be mounted on other types of holder arrangements for attaching the nozzle 44 to another portion of the user's body. For example, an arm band or shoulder strap may be used, and the nozzle 44 need not be mounted to the user's head.

Referring now to FIG. 1A, the quick charge adapter 80 is shown in cross section. The quick charge adapter 80 is adapted to be placed in fluid communication with a pressurized fluid source. The quick charge adapter 80 includes a housing 82 having a receptacle 84. The recharge nozzle 26 of the control unit 12, shown in phantom lines as 26' and 12', respectively, in FIG. 1A in the charging position, is adapted to be inserted into the quick charge adapter 80 at the receptacle 84. A valve body 86 is located within the quick charge adapter housing 82. The valve body 86 has a channel 87 defined therethrough. The valve body 86 is biased to a closed position via a spring 88 which causes an O-ring seal 90 located on the valve body 86 to seal against an inside portion of the housing 82, preventing pressurized fluid from leaking from the quick charge adapter 80 when not in use. A hose connection 92 is provided for connecting a garden hose or other source of pressurized fluid to the quick charge adapter 80.

In operation, the recharge nozzle 26 on the control unit 12 is inserted into the receptacle 84 of the quick charge adapter 80, pushing down the valve body 86 which allows pressurized fluid from the fluid source to enter the channel 87 in the valve body 86. The O-ring 28 seals the connection between the recharge nozzle 26 and the receptacle 84. The flow of pressurized fluid from the quick charge adapter 80 overcomes the force of the recharge nozzle spring 25 and opens the check valve 24 located in the recharge nozzle 26, allowing pressurized fluid to flow from the quick charge adapter 80, through the recharge nozzle 26, the control unit manifold 15 and the first hose 22 to the bladder assembly 50, to charge the expandable bladder 54 with fluid under pressure. The expandable bladder 54 is charged with pressurized fluid and expands in size to fill the bladder housing 52. The expandable bladder 54 expands within the confines of the bladder housing 52, which supports the expandable bladder 54 and limits further expansion of the expandable bladder 54 in order to prevent over-pressurization. Once the expandable bladder 54 is expanded, the pressure relief valve 34 is actuated to prevent over-pressurization of the bladder 54 and the entire gun device 10. The pressure relief valve 34 discharges fluid to outside the control unit 12. When the user observes fluid flowing from the pressure relief valve 34, the recharge nozzle 26 is removed from the receptacle 84 on the quick charge adapter 80. The gun device 10 is then ready for use whereby, upon activation of the control unit 12, contraction of the expanded bladder 54 provides a motive force for ejecting the fluid from the nozzle assembly 40.

Referring to FIGS. 1A and 1C, when the user desires to shoot, the user depresses the trigger 30. The trigger 30 opens the release valve 32, allowing the fluid under pressure from the expanded bladder 54 to flow through the first hose 22 and the control unit 12 to the second hose 42 and into the nozzle body 45 where the fluid is ejected out through the nozzle 44. When the nozzle 44 is connected to a headband 46, as shown, the user can direct the flow of fluid in the direction in which the user turns their head. When the trigger 30 is released, the release valve 32 closes, shutting off the flow of fluid from the bladder 54, the first hose 22, and the control unit 12 to the second hose 42.

In the preferred embodiment, the control unit housing 14, the bladder housing 52, the quick charge adapter housing 82 and the nozzle assembly 40 are molded from a polymeric material. The first hose 22 and the second hose 42 are made of flexible polymeric material. However, it will be recognized by those skilled in the art that any other suitable material may be used, and the material may be molded, machined, or formed using any suitable method in order to form the system components.

Further, in the preferred embodiment, only one expandable bladder 54 and bladder housing 52 are employed. However, it will be recognized by those skilled in the art that a plurality of bladders may be provided in fluid communication with the control unit 15. Preferably, the bladder 54 is made of natural rubber. However, a synthetic bladder material may also be used, if desired.

It will be appreciated by those skilled in the art that changes can be made to the embodiment described above without departing from the broad inventive concept thereof It is understood, therefore, that the invention is not limited to the particular embodiment disclosed and is intended to cover modifications within the scope and spirit of the present invention as defined in the appended claims.

What is claimed is:

1. A gun device for ejecting fluid comprising:

a bladder assembly including an expandable bladder located therein, a control unit in fluid communication with the expandable bladder, the control unit being located separately and remotely from and connected to the bladder assembly only by a hose; and a nozzle assembly in fluid communication with the control unit, the nozzle assembly being located separately and remotely from the control unit and the bladder assembly, the nozzle assembly being connected to the control unit only by a hose whereby activation of the control unit allows pressurized fluid to flow from the bladder assembly, through the control unit and to the nozzle assembly for discharge, without flowing through a trigger-controlled valve located in the nozzle assembly.

2. The gun device according to claim 1, wherein the bladder assembly includes a bladder housing, the bladder housing has an open end, the expandable bladder has an open first end and a closed second end, the expandable bladder being located in the bladder housing.

3. The gun device according to claim 2, wherein the bladder housing includes a hanger such that the bladder assembly is adapted to be worn by a user.

4. The gun device according to claim 1, wherein a pressure relief valve is located in fluid communication with the control unit.

5. The gun device according to claim 4, wherein the pressure relief valve is located on the control unit.

6. The gun device according to claim 1, wherein the nozzle assembly includes a nozzle body connected to an adjustable band such that the nozzle assembly is adapted to be worn by a user.

7. The gun device according to claim 6, wherein the adjustable band is a headband.

8. The gun device according to claim 1, wherein the control unit includes:

a control unit housing;

a trigger mounted for movement on the control unit housing;

a control unit manifold located in the control unit housing and in fluid communication with the expandable bladder such that fluid can flow between the expandable bladder and the control unit manifold;

a release valve connected to the trigger and in fluid communication with the control unit manifold whereby activation of the trigger opens the release valve to pass fluid from the control unit manifold to the nozzle assembly for discharge; and a recharge nozzle in fluid communication with the control unit manifold, the recharge nozzle being adapted to be inserted into a quick charge adapter such that pressurized fluid flows from the quick charge adapter, through the recharge nozzle and the control unit manifold to the expandable bladder in the bladder assembly such that the expandable bladder is expanded by the pressurized fluid.

9. A combination of a gun device and a quick charge adapter for charging the gun device with pressurized fluid comprising:

a bladder assembly including an expandable bladder located therein;

a control unit in fluid communication with the expandable bladder, the control unit being located separately and remotely from and connected to the bladder assembly only by a hose the bladder assembly;

a recharge nozzle in fluid communication with the control unit;

a nozzle assembly in fluid communication with the control unit, the nozzle assembly being located separately and remotely from the control unit and the bladder assembly, the nozzle assembly being connected to the control unit only by a hose, whereby activation of the control unit allows pressurized fluid to flow from the bladder assembly, through the control unit, and to the nozzle assembly, without flowing through a trigger-controlled valve located in the nozzle assembly; and a quick charge adapter adapted to be placed in fluid communication with a pressurized fluid source, the quick charge adapter including a receptacle adapted to receive the recharge nozzle of the control unit and the recharge nozzle being adapted to be inserted into the quick charge adapter such that pressurized fluid flows from the quick charge adapter, through the recharge nozzle and the control unit manifold to the bladder assembly to charge the expandable bladder with fluid under pressure.

10. The combination according to claim 9, wherein the bladder assembly includes a bladder housing and the expandable bladder is located in the bladder housing whereby, upon charging the expandable bladder with fluid, the expandable bladder expands and is supported by the bladder housing, and upon activation of the control unit, contraction of the expanded bladder provides a motive force for ejecting the fluid from the nozzle assembly.

11. The combination according to claim 9, wherein a pressure relief valve is located in fluid communication with the control unit.

12. The combination according to claim 11, wherein the pressure relief valve is located on the control unit.

13. The combination according to claim 9, wherein the bladder assembly includes a hanger such that the bladder assembly is adaptable to be worn by a user.

14. The combination according to claim 9, wherein the nozzle assembly includes a nozzle housing connected to an adjustable band such that the nozzle assembly is adapted to be worn by a user.

15. The combination according to claim 14, wherein the adjustable band is a headband.

16. The combination according to claim 9, wherein the control unit includes:

a control unit housing;

a control unit manifold located in the control unit housing and in fluid communication with the expandable bladder whereby fluid can flow between the expandable bladder and the control unit manifold;

a trigger mounted for movement on the control unit housing;

a release valve connected to the trigger and in fluid communication with the control unit manifold whereby activation of the trigger opens the release valve to pass fluid to the nozzle assembly;

the recharge nozzle being in fluid communication with the control unit manifold and located on the control unit housing such that, when the recharge nozzle is inserted into the receptacle of the quick charge adapter, pressurized fluid flows from the quick charge adapter, through the recharge nozzle and the control unit manifold to the expandable bladder such that the expandable bladder is expanded by the pressurized fluid; and a pressure relief valve in fluid communication with the control unit manifold.

17. A combination of a gun device and a quick charge adapter comprising:

a bladder assembly including a bladder housing having an open end, an expandable bladder located within the bladder housing, the expandable bladder having an open first end and a closed second end, and mounting provisions connected to the bladder housing such that the bladder assembly is adapted to be worn by a user, a control unit located separately and remotely from the bladder assembly and in fluid communication with the expandable bladder, the control unit being connected to the bladder assembly only by a hose and including:

a control unit housing, a control unit manifold located in the control unit housing, the control unit manifold being in fluid communication with the bladder assembly whereby fluid can flow between the expandable bladder and the control unit manifold, a trigger, pivotally mounted to the control unit housing, a release valve connected to the trigger and in fluid communication with the control unit manifold, a pressure relief valve in fluid communication with the control unit, and a recharge nozzle in fluid communication with the control unit manifold;

a nozzle assembly located separately and remotely from and in fluid communication with the control unit, the nozzle assembly being connected to the control unit only by a hose whereby activation of the trigger allows pressurized fluid to flow from the bladder assembly, through the control unit, to the nozzle assembly for ejection therefrom without flowing through a trigger-controlled valve located in the nozzle assembly; and a quick charge adapter adapted to be in fluid communication with a pressurized fluid source, the recharge nozzle being adapted to be inserted into the quick charge adapter to place the pressurized fluid source into fluid communication with the expandable bladder, such that pressurized fluid flows from the quick charge adapter, through the recharge nozzle and the control unit to the expandable bladder such that the expandable bladder is expanded by the pressurized fluid.

* * * * *